US006204749B1

(12) United States Patent
Ishihara

(10) Patent No.: US 6,204,749 B1
(45) **Date of Patent: *Mar. 20, 2001**

(54) VARIABLE RESISTOR HAVING TERMINAL AND SUBSTRATE CONNECTED ON THE OPENING SIDE OF CASING

(75) Inventor: Kanji Ishihara, Miyagi-ken (JP)

(73) Assignee: ALPS Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/924,216

(22) Filed: Sep. 5, 1997

(30) Foreign Application Priority Data

Sep. 18, 1996 (JP) ..... 8-267796

(51) Int. Cl.[7] ..... H01C 10/38

(52) U.S. Cl. ..... 338/176; 338/199; 338/160; 338/184

(58) Field of Search ..... 358/118, 160, 358/176, 183, 184, 199; 338/33

(56) References Cited

U.S. PATENT DOCUMENTS

| | | | | |
|---|---|---|---|---|
| 2,850,608 | * | 9/1958 | Bourns et al. | 338/183 |
| 4,213,112 | | 7/1980 | Alman et al. | 338/183 |
| 4,284,969 | | 8/1981 | Carbonneau | 338/183 |
| 4,894,638 | * | 1/1990 | Flierl et al. | 338/184 |
| 5,072,206 | * | 12/1991 | Kozuka et al. | 338/184 |
| 5,345,215 | | 9/1994 | Okumura et al. | 338/176 |
| 5,435,181 | * | 7/1995 | Koebernik | 338/33 |

* cited by examiner

*Primary Examiner*—Karl D. Easthom
(74) *Attorney, Agent, or Firm*—Brinks Hofer Gilson & Lione

(57) ABSTRACT

A variable resistor for increased assembly efficiency and decreased influence by environmental changes is disclosed. The variable resistor includes a closed end main casing, an external terminal held in the main casing and connected to the insulating substrate, a side receiver movably held in the casing, a shaft for moving the slider receiver, and a cover for closing an opening of the casing. The shaft is supported by a bearing formed on the cover to protrude from the cover and is further provided with a fall-preventive means. The terminal and substrate are both connected on the opening side of the casing.

6 Claims, 6 Drawing Sheets

VARIABLE RESISTOR HAVING TERMINAL AND SUBSTRATE CONNECTED ON THE OPENING SIDE OF CASING

BACKGROUND OF THE INVENTION

1. Field of the Invention

The present invention relates to an electric part for use as, for example, a valve opening control sensor for an exhaust gas recirculator in a vehicle, a sensor for controlling the mixture ratio between gasoline and air, and various kinds of encoders.

2. Description of the Related Art

A conventional electric part of this type will be described with reference to a cross-sectional view of FIG. 13. The electric part shown in FIG. 13 comprises a casing 1 which forms an outer shell, a shaft 2 movable from side to side in FIG. 13 with respect to the casing 1, an insulating substrate 3 housed in the casing 1, a brush 4 which slidably contacts a conductive pattern (not shown), such as a resistor or a current collector, provided on the insulating substrate 3, a slider receiver 5 for holding the brush 4, a return spring 6 positioned offset from the axis of the shaft 2 to supply a spring force to the slider receiver 5, and an external terminal 7 connected to the insulating substrate 3.

In the casing 1, the shaft 2 is inserted into a slot 1*a* provided at one end of the casing 1, and an opening 1*b* at the other end is tightly sealed with a cover 8. A pair of guide grooves (not shown), extending parallel to the axis of the shaft 2, are formed on opposed inner walls of the casing 1, and a pair of projections 5*a* formed on the slider receiver 5 are engaged with the guide grooves.

The insulating substrate 3 housed in the casing 1 is engaged, at both side ends thereof, with a second pair of grooves formed on the opposed inner walls of the casing 1, and urged toward the slider receiver 5 by a corrugated leaf spring 9 interposed between the casing 1 and the back of the insulating substrate 3.

At one end of the insulating substrate 3, a terminal section 3*a* having thereon a conductive terminal pattern (not shown) connected to the resistor or the current collector is formed. A connecting section 7*a* is formed at one end of the external terminal 7. The terminal section 3*a* of the insulating substrate 3 and the connecting section 7*a* of the external terminal 7 are connected to each other by a clip terminal 10 on the side of the opening 1*b* of the casing 1. Furthermore, a groove 11 for holding the return spring 6 is formed at the position offset from the axis of the shaft 2 in the casing 1, and the return spring 6 held in the groove 11 urges the slider receiver 5 in the axial direction. The shaft 2 and the slider receiver 5 are provided with a convex section 2*a* and a concave section 5*b*, respectively, which are engaged with each other. A hole 1*c* is formed for use in attaching this electric part to other devices.

The conventional electric part having the above-mentioned construction is assembled as follows: First, the leaf spring 9 and the insulating substrate 3 are loaded in the casing 1. Next, the shaft 2 is inserted into the slot 1*a*, which is formed at the other side of the opening 1*b* of the casing 1, from the side of the opening 1*b*, the pair of projections 5*a* of the slider receiver 5 are engaged with the pair of grooves in the casing 1, and the slider receiver 5 is engaged with the shaft 2. Then, the terminal section 3*a* of the insulating substrate 3 and the connecting section 7*a* of the external terminal 7 are resiliently clamped by the clip terminal 10, and the return spring 6 is inserted into the groove 11 for housing the spring in the casing 1. Finally, the opening 1*b* of the casing 1 is closed by the cover 8.

In the foregoing electric part, however, since the shaft 2 must be inserted into the slot 1*a* located on the side of the casing 1 which is far back from the opening 1*b*, insertion is difficult, and assembly efficiency is thereby reduced.

The electric part constructed as mentioned above is, for example, attached to a control valve container 12, as a valve opening detecting sensor for use in an exhaust gas recirculator in an engine, through an attachment member 13 or the like, as shown in FIG. 14. The electric part is so attached that the shaft 2 projects into the control valve container 12 and that hermetic sealing is provided between the electric part and the control valve container 12. The shaft 2 moves inward and outward in correlation to the motion of a control valve (not shown) in the control valve container 12.

In such a state in which the electric part is attached to the control valve container 12, the cover 8 covering the opening 1*b* of the casing 1 is exposed outside. Therefore, even if the opening 1*b* of the casing 1 is tightly sealed with the cover 8, the sealing state is deteriorated under the influence of long-term changes in the external environment, such as temperature and humidity, dust or the like, whereby the contact between the brush 4 in the casing 1 and the resistor and the current collector on the insulating substrate 3 is made unstable.

SUMMARY OF THE INVENTION

Accordingly, it is an object of the present invention to provide an electric part which is excellent in assembly efficiency and is not influenced by environmental changes.

In order to achieve the above object, the present invention provides an electric part comprising a closed-end main casing, an insulating substrate held in the casing, an external terminal held in the main casing and connected to the insulating substrate, a slider receiver movably held in the casing, a shaft for moving the slider receiver, and a cover for closing an opening of the casing, wherein the shaft is supported by a bearing formed on the cover to protrude from the cover and further provided with a fall-preventive means, the insulating substrate has a terminal section at one end thereof, the outer terminal has a connecting section at one end thereof, and the terminal section and the connecting section are projected toward the opening of the casing and connected to each other by a clip terminal.

Furthermore, the cover is provided with a through hole, and the terminal section of the insulating substrate and the connecting section of the external terminal protrude outward through the through hole and are connected to each other.

Still furthermore, a protective cover for covering the terminal section of the insulating substrate and the connecting section of the external terminal is provided on the cover.

DESCRIPTION OF THE PREFERRED EMBODIMENTS

Figure 1:
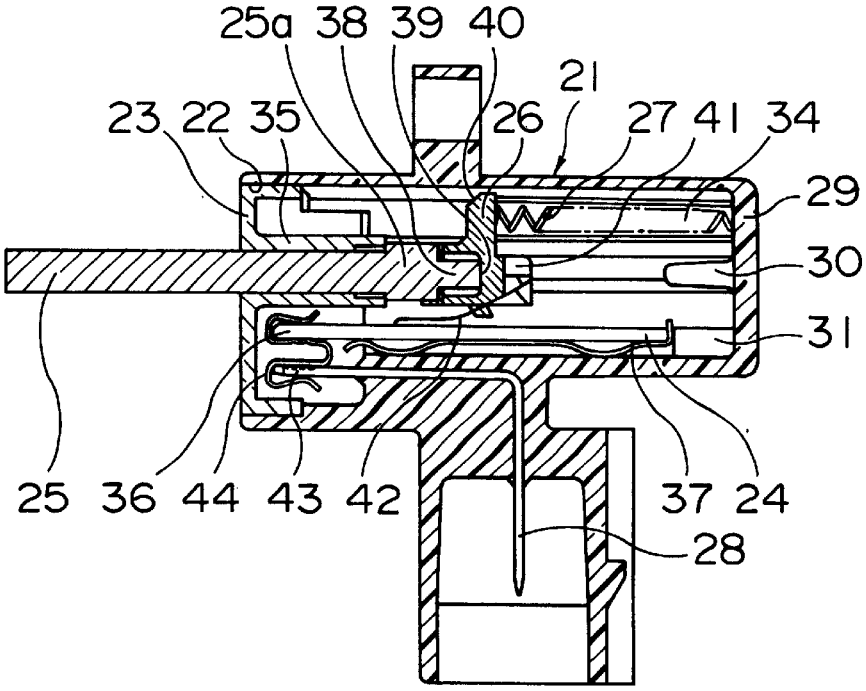
FIG. 1 is a longitudinal sectional view of an electric part according to a first embodiment of the present invention.
Figure 3:
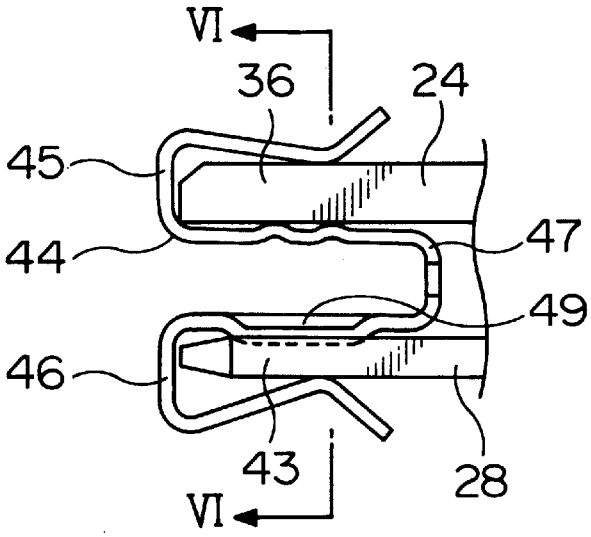
FIG. 3 is a side view showing the contact state between an insulating substrate and an external terminal in the electric part of the first embodiment.
Figure 4:
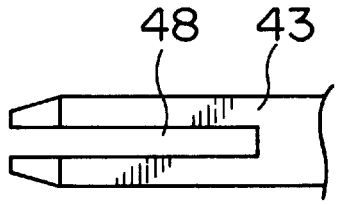
FIG. 4 is a plan view of a connecting section of the external terminal in the electric part of the first embodiment.
Figure 5:
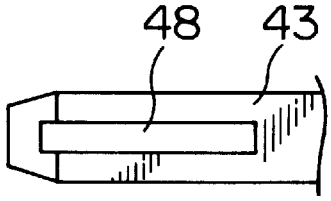
FIG. 5 is a plan view of a connecting section of the external terminal in the electric part of the first embodiment.
Figure 6:
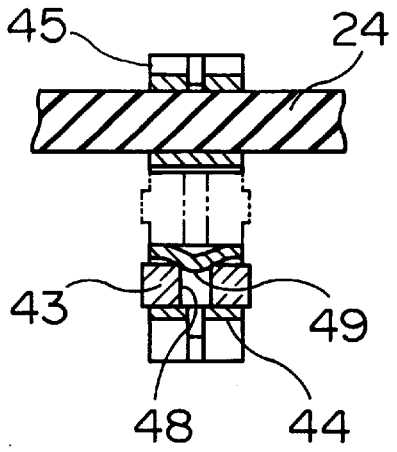
FIG. 6 is a cross-sectional view taken along line VI—VI of FIG. 3.
Figure 7:
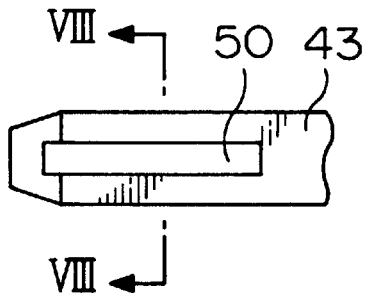
FIG. 7 is a plan view of a connecting section of the external terminal in the electric part of the first embodiment.
Figure 8:
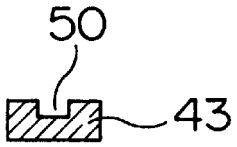
FIG. 8 is a cross-sectional view taken along line VIII—VIII of FIG. 7.

An electric part according to a first embodiment of the present invention will be described with reference to FIGS. 1 to 8. FIG. 1 is a longitudinal sectional view of an electric part of the first embodiment, which is taken in the axial direction of a shaft, FIG. 2 is a front view showing the inside of a casing shown in FIG. 1, FIG. 3 is a side view showing the contact state between an insulating substrate and an external terminal, FIGS. 4 and 5 are plan views of the external terminal, FIG. 6 is a cross-sectional view taken along line VI—VI of FIG. 3, FIG. 7 is a plan view of the external terminal, and FIG. 8 is a cross-sectional view taken along line VIII—VIII of FIG. 7.

Figure 2:
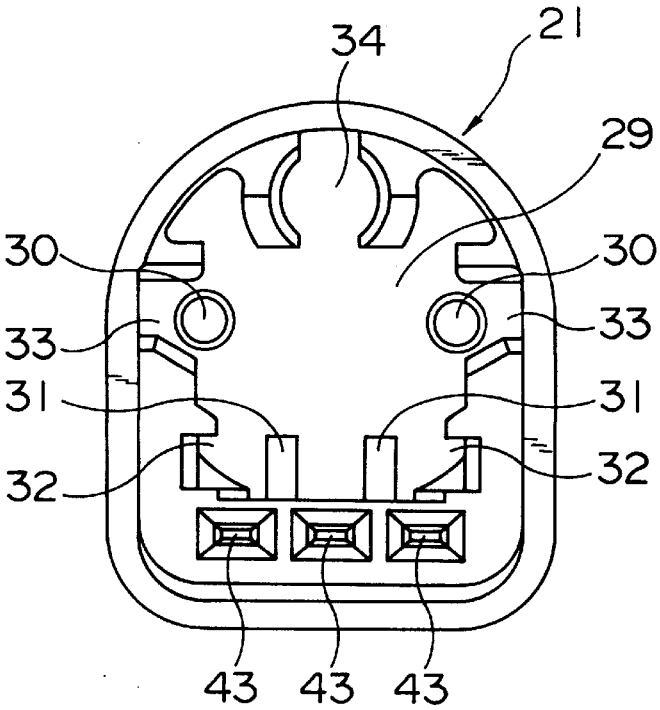
FIG. 2 is a front view showing the inside of a casing of the electric part in the first embodiment.

As shown in FIGS. 1 and 2, the electric part of the present invention mainly comprises a closed-end casing 21, a cover 23 for closing an opening 22 of the casing 21, an insulating substrate 24 housed in the casing 21, a shaft 25, a slider receiver 26 retained by the shaft 25 and being movable in the axial direction of the shaft 25 in the casing 21, a return spring 27 for urging the slider receiver 26 in the axial direction, and an external terminal 28 held in the casing 21.

The casing 21 is made of synthetic resin or the like. A pair of stoppers 30 for limiting the movement of the slider receiver 26 are projected from an end section 29 of the casing 21, and a pair of projections 31 are formed to position the insulating substrate 24. Furthermore, two pairs of opposed grooves 32 and 33 and a housing groove 34 for housing the return spring 27 therein are formed on the inner wall of the casing 21 as shown in FIG. 2.

A cylindrical bearing 35, through which the shaft 25 is inserted, is formed at about the midpoint of the cover 23 to extend inward of the casing 21. The cover 23 is fitted in the inner wall of the casing 21 near the opening 22 thereof, thereby closing the opening 22.

The insulating substrate 24 to be housed in the casing 21 is provided with a resistor and a current collector (both are not shown) on the upper surface thereof, and a terminal section 36 having a conductive terminal pattern (not shown) connected to the resistor and the current collector at one end thereof. Both side ends of the insulating substrate 24 are inserted in the pair of grooves 32 in the casing 21 shown in FIG. 2, and the other end thereof is held in contact with the positioning projections 31. Furthermore, the insulating substrate 24 is urged toward the slider receiver 26 (upward) by a corrugated leaf spring 37 interposed between the back of the insulating substrate 24 and the inner wall of the casing 21, and is thereby prevented from rattling in the vertical direction. In this state, the terminal section 36 of the insulating substrate 24 projects toward the opening 22 of the casing 21.

The shaft 25 to be inserted through the bearing 35 of the cover 23 is provided with a large-diameter section 25*a* as a fall-preventive means, and a convex section 38 formed at the leading end of the large-diameter section 25*a*. On the other hand, the slider receiver 26 is provided with a concave section 39 opposed to the convex section 38 and having a large diameter than the convex section 38. The convex section 38 is engaged with the concave section 39. The slider receiver 26 is further provided with a head section 40 projecting into the spring housing groove 34 in the casing 21, a pair of engaging projections 41 formed on the right and left sides in the moving direction of the slider receiver 26 to be engaged with the pair of grooves 33 in the casing 21, and a slider 42 for sliding over the resistor and the current collector on the insulating substrate 24. The slide receiver 26 is moved against the urging force of the return spring 27 by the pressing force applied to the shaft 25 from outside.

The external terminal 28 is held in the casing 21 by means of insert molding or the like. The external terminal 28 is provided with a connecting section 43 at one end to project parallel to the terminal section 36 of the insulating substrate 24 toward the opening 22, and the other end thereof is bent and projected sideward from the casing 21. The terminal section 36 of the insulating substrate 24 and the connecting section 43 of the external terminal 28 are connected to each other by a connecting means such as a clip terminal 44. Accordingly, the connection is easily achieved only by resiliently clamping the terminal section 36 and the connecting section 43 with the clip terminal 44.

The clip terminal 44 is, as shown in FIG. 3, composed of two clip sections 45 and 46 for resiliently clamping the terminal section 36 of the insulating substrate 24 and the connecting section 43 of the external terminal 28, and a linking section 47 for linking the clip sections 45 and 46. The connecting section 43 of the external terminal 28 to be resiliently clamped by the clip section 46 is provided with a cutout groove 48 as shown in FIG. 4 or 5. On the other hand, the clip section 46 is provided with a bent section 49 which is V-shaped in cross section. As shown in FIG. 6, the bent section 49 is engaged with the cutout groove 48, whereby the connecting section 43 is resiliently clamped by the clip section 46. The connecting section 43 may be provided with a concave groove 50 shown in FIGS. 7 and 8 instead of the cutout groove 48 shown in FIGS. 4 and 5.

Since the terminal section 36 of the insulating substrate 24 and the connecting section 43 of the external terminal 43 are thus connected by the clip terminal 44, it is only necessary to insert and engage the bent section 49 of the clip terminal 44 with the cutout groove 48 or the concave groove 50 formed on the connecting section 43 of the external terminal 28, and the connecting operation is easy. Such engagement of the cutout groove 48 or the concave groove 50 formed on the connecting section 43 of the external terminal 28 with the V-shaped bent section 49 of the clip section 46 of the clip terminal 44 enhances reliability of connection.

The electric part of the present invention having the foregoing construction is assembled as follows. First, the insulating substrate 24 is inserted together with the leaf spring 37 into the casing 21 holding the external terminal 28 while both side ends thereof are engaged with the grooves 32, and brought into contact with the positioning projections 31. The return spring 27 is inserted in the spring housing section 34. Next, the slider receiver 26 is inserted into the casing 21 while the pair of engaging projections 41 thereof are engaged with the pair of grooves 33 in the casing 21. Then, the terminal section 36 of the insulating substrate 24 and the connecting section 43 of the external terminal 28 are resiliently clamped by the two clip sections 45 and 46 of the clip terminal 44 as a connecting means.

In this case, the slider receiver 26 is pressed back toward the opening 22 of the casing 21 by the return spring 27 to such an extent that the return spring 27 stretches to its full length. As a result, the leading end of the slider 42 retained by the pressed slider receiver 26 is brought near the terminal section 36 of the insulating substrate 24 and positioned at a desired distance from the clip terminal 44. In this state, the terminal section 36 of the insulating substrate 24 and the connecting section 43 of the external terminal 28 are connected by the clip terminal 44. Next, the shaft 25 is engaged with the slider receiver 26, and the opening 22 of the casing 21 is closed by the cover 23. At this time, if the shaft 25 is inserted in the bearing 35 of the cover 23 beforehand, the convex section 38 of the shaft 25 can be engaged with the concave section 39 of the slider receiver 26 by fitting the cover 23 in the opening 22 of the casing 21. The shaft 25 is prevented from falling off by the fall-preventive means 25*a*. At the same time, the spring 27 is slightly compressed.

As mentioned above, the electric part according to the first embodiment of the present invention has high assembly efficiency because the shaft 25 can be inserted in the casing 21 and engaged with the slider receiver 26 only by fitting the cover 23 in the opening 22 of the casing 21. Furthermore, since the shaft 25 moves in and out of the cover 23 closing the opening 22 of the casing 21, when the electric part is attached, as a sensor, to a control valve container in an exhaust gas recirculator of an engine or the like, the components of the electric part on the side of the opening 22 including the shaft 25 are sealed in the container and only the end section 29 of the casing 21 is exposed outside. Consequently, contact failure of the slider 42 and the clip terminal 44 is prevented from being caused by changes in the environment such as external humidity.

In the first embodiment, if the shaft 25 and the slider receiver 26 are integrally formed, the cover 23 can be fitted in the casing 21 after simultaneously inserting the shaft 25 and the slider receiver 26 into the casing 21. In this case, since the shaft 25 and the slider receiver 26 formed integrally can be simultaneously inserted into the casing 21, the assembly operation is facilitated.

Figure 9:
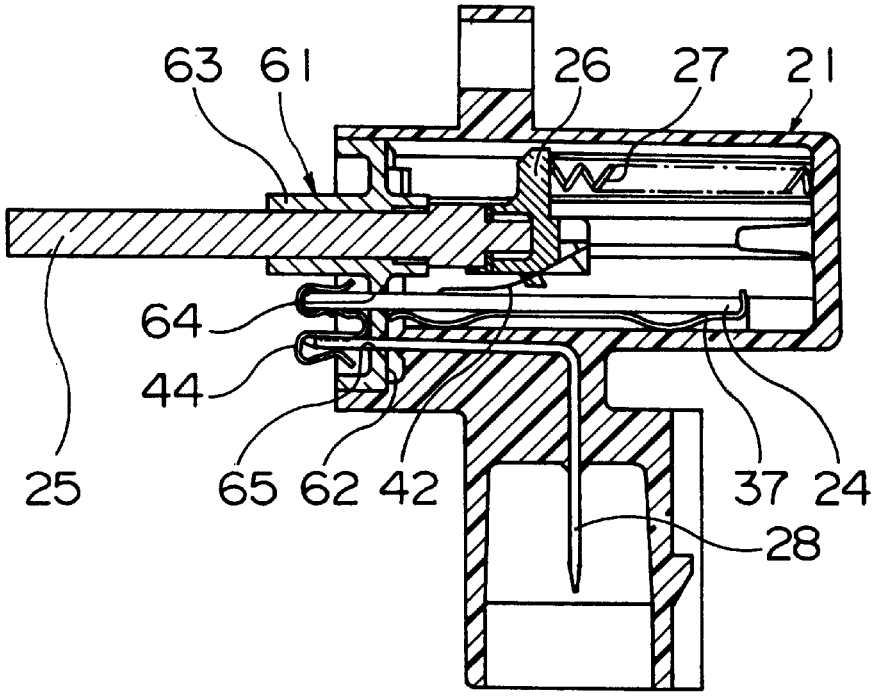
FIG. 9 is a longitudinal sectional view of an electric part according to a second embodiment of the present invention.
Figure 10:
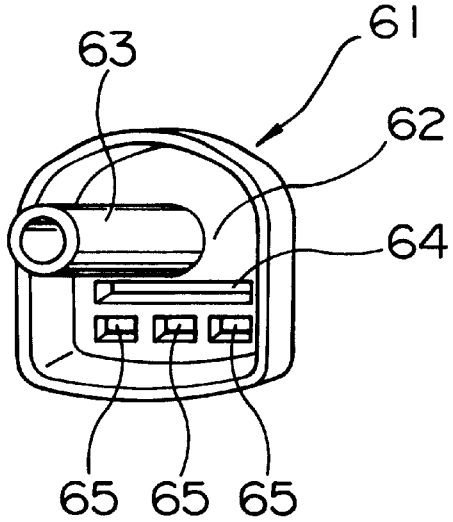
FIG. 10 is a perspective view of a cover to be used in the electric part of the second embodiment.

Next, a second embodiment of the present invention will be described with reference to FIGS. 9 and 10. FIG. 9 is a side sectional view of an electric part according to the second embodiment of the present invention, and FIG. 10 is a perspective view of a cover to be used in the electric part shown in FIG. 9. Components which are the same as in the electric part of the first embodiment are given the same reference numerals, and the description thereof is omitted.

The electric part of the second embodiment is different from the first embodiment in having a cover 61. Other components, a casing 21, an insulating substrate 24, a shaft 25, a slider receiver 26, a return spring 27, an external terminal 28, a leaf spring 37, a slider 42 and a clip terminal 44 are the same as those in the electric part of the first embodiment.

The cover 61 for closing an opening 22 of the casing 21 has an almost concave shape as shown in FIGS. 9 and 10, and a cylindrical bearing 63 projecting outward and inward the casing 21 is formed at about the midpoint of a concave bottom 62 thereof. A slit 64 through which a terminal section 36 of the insulating substrate 24 is inserted, and three slits 65 through which a connecting section 43 of the external terminal 28 is inserted are formed in parallel on the bottom 62.

The electric part of the second embodiment which has the foregoing cover 61 is assembled as follows. First, the insulating substrate 24 is inserted together with the leaf spring 37 into the casing 21 holding the external terminal 28 while both side ends thereof are engaged with grooves 32, and brought into contact with positioning projections 31. The return spring 27 is inserted in a spring housing section 34. Next, the slider receiver 26 is inserted into the casing 21 while a pair of engaging projections 41 thereof are engaged with a pair of grooves 33 in the casing 21.

Though these assembly steps are the same as those of the electric part of the first embodiment, in the second embodiment, the cover 61 having the shaft 25 inserted through the bearing 63 beforehand is next fitted in the opening 22 of the casing 21, thereby closing the opening 22. Then, the terminal section 36 of the insulating substrate 24 and the connecting section 43 of the external terminal 28 are resiliently clamped by the clip terminal 44. In other words, when the cover 61 is fitted in the casing opening 22, the terminal section 36 of the insulating substrate 24 and the connecting section 43 of the external terminal 28 are respectively inserted into the slits 64 and 65 formed on the bottom 62 of the cover 61 and projected outward. Next, these projecting terminal section 36 and connecting section 43 are resiliently clamped by the clip terminal 44 and connected to each other.

As mentioned above, in the second embodiment, since the cover 61 is fitted in the casing 21 before the terminal section 36 of the insulating substrate 24 and the connecting section 43 of the external terminal 28 are resiliently clamped by the clip terminal 44, the slider receiver 26 retained by the shaft 25 is held in the casing 21. Only the terminal section 36 of the insulating substrate 24 and the connecting section 43 of the external terminal 28 project from the cover 61, and therefore, it is easy to make the clip terminal 44 resiliently clamp the terminal section 36 and the connecting section 43. In the second embodiment, if the shaft 25 and the slider receiver 26 are integrally formed, the slider receiver 26 can be inserted into the casing 21 upon fitting the cover 61 in the opening 22 of the casing 21, which makes the assembly operation simpler. In the first embodiment, the clip terminal 44 is required to be mounted without any contact with the slider 42, and therefore, the insulating substrate 24 is required to extend in the lengthwise direction of the external terminal 28 so as to have the length including the full length of the return spring 27 and an additive allowance. However, in the second embodiment, the slider receiver 26 can place the return spring 27 into a compressed position in mounting the clip terminal 44, whereby the slider receiver 26 can be placed at a farther position inside the casing 21. As a result, the insulating substrate 24 can be shortened.

Figure 11:
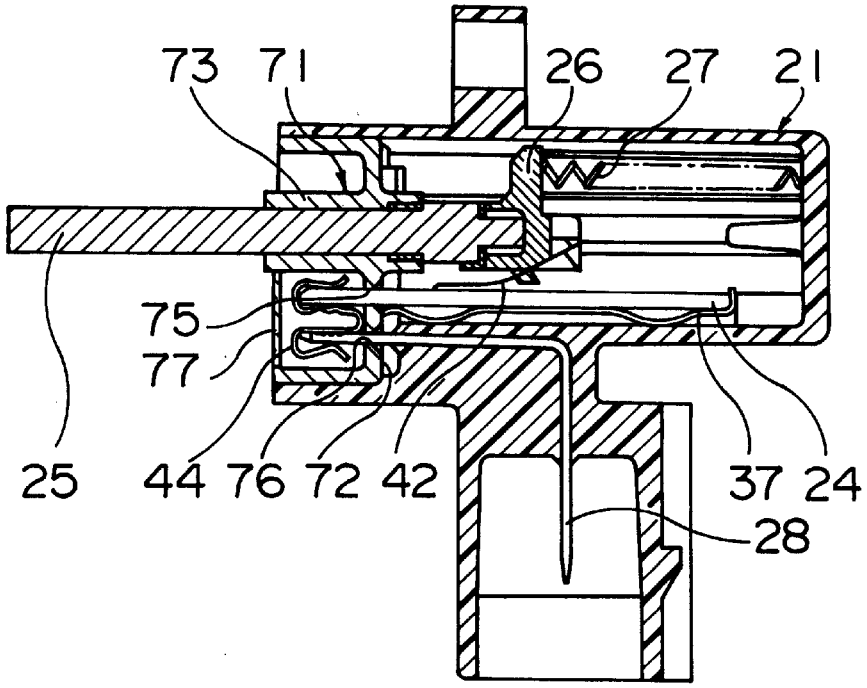
FIG. 11 is a longitudinal sectional view of an electric part according to a third embodiment of the present invention.
Figure 12:
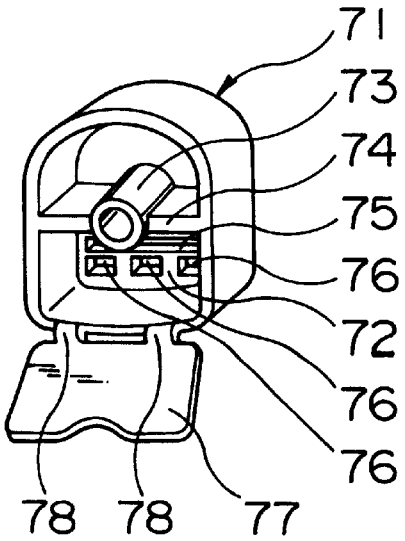
FIG. 12 is a perspective view of a cover to be used in the electric part of the third embodiment.
Figure 13:
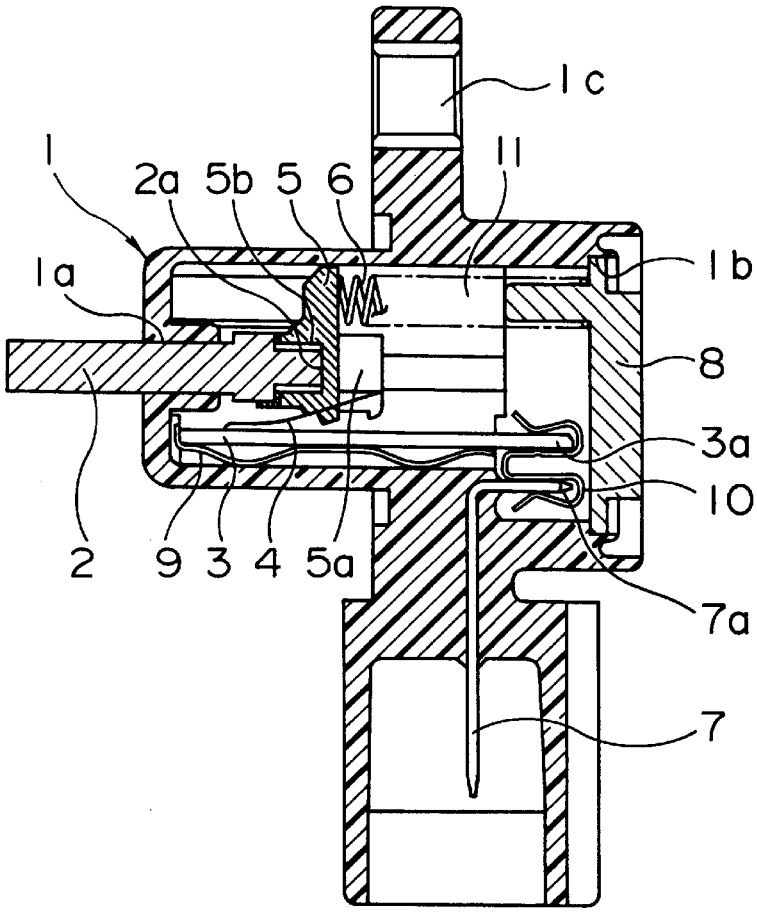
FIG. 13 PRIOR ART
FIG. 13 is a longitudinal sectional view of a conventional electric part.
Figure 14:
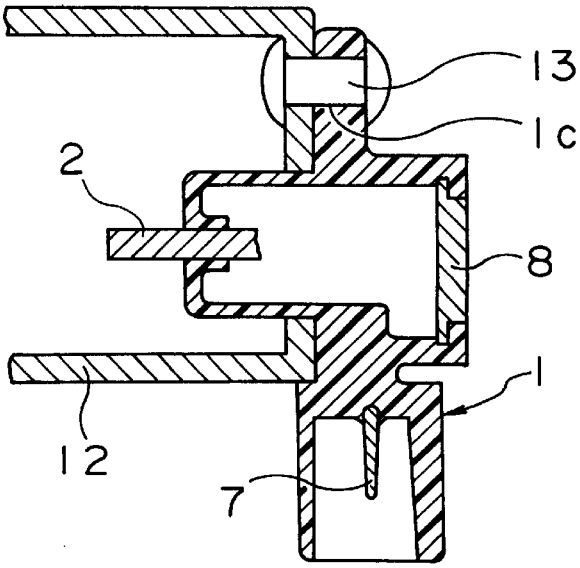
FIG. 14 PRIOR ART
FIG. 14 is a view explaining the case of use of the conventional electric part.

Next, a third embodiment of the present invention will be described with reference to FIGS. 11 and 12. FIG. 11 is a side sectional view of an electric part according to the third embodiment of the present invention, and FIG. 12 is a perspective view of a cover to be used in the electric part shown in FIG. 11. In these figures, components which are the same as in the electric part of the first embodiment are given the same reference numerals, and the description thereof will be omitted.

The electric part of the third embodiment is different from the second embodiment in having a cover 71. Other components, a casing 21, an insulating substrate 24, a shaft 25, a slider receiver 26, a return spring 27, an external terminal 28, a leaf spring 37, a slider 42 and a clip terminal 44 are the same as those in the electric part of the second embodiment.

The cover 71 for closing the opening 22 of the casing 21 has an almost concave shape as shown in FIGS. 11 and 12, and a cylindrical bearing 73 projecting outward and inward the casing 21 is formed at about the midpoint of a concave bottom 72 thereof. The bottom 72 is further provided with a divider wall 74 formed integrally with the bearing 73 and projecting outward, a slit 75 through which a terminal section 36 of the insulating substrate 24 is inserted, and three slits 76 through which a connecting section 43 of the external terminal 28 is inserted. These slits are formed in parallel. Furthermore, the cover 71 has a protective cover 77 integrally formed therewith through hinges 78.

The electric part of the third embodiment having the foregoing cover 71 is assembled just the same as the electric part of the second embodiment. In other words, the insulating substrate 24 is inserted together with the leaf spring 37 into the casing 21 holding the external terminal 28, and the return spring 27 is inserted in a spring housing section 34. Next, the slider receiver 26 is inserted into the casing 21.

Then, the cover 71 having the shaft 25 inserted through the bearing 73 beforehand is fitted in the opening 22 of the casing 21, and then, a convex section 38 of the shaft 25 is engaged with a concave section 39 of the slider receiver 26. The terminal section 36 of the insulating substrate 24 and the connecting section 43 of the external terminal 28 are respectively inserted into the slits 75 and 76 formed on the bottom 72 of the cover 71 and projected outward, and then, connected to each other by being resiliently clamped by the clip terminal 44. Finally, the protective cover 77 is fitted on the bearing 73, thereby covering the clip terminal 44. The protective cover 77 may be a separate piece. In the third embodiment, if the shaft 25 and the slider receiver 26 are integrally formed, the slider receiver 26 can be inserted in the casing 21 upon fitting the cover 71 in the opening 22 of the casing 21, which facilitates the assembly operation.

As mentioned above, since the protective cover 77 covers the clip terminal 44, the ingress of dirt and dust is prevented, which achieves more reliable contact between the clip terminal 44, and the terminal section 36 of the insulating substrate 24 and the connecting section 43 of the external terminal 28.

According to the present invention, as mentioned above, since the cover is provided with the bearing for supporting the shaft having a fall-preventive means, the shaft can be engaged with a slider receiver and inserted in the casing by fitting the cover in the opening of the casing, which enhances assembly efficiency. Furthermore, since the shaft moves in and out of the cover for closing the opening of the casing, when the electric part is attached, as a sensor, to a control valve container in an exhaust gas recirculator of an engine or the like, the components of the electric part on the side of the opening including the shaft are sealed in the housing and only the end section of the casing is exposed outside the housing. Consequently, contact failure of the slider and the clip terminal is prevented from being caused by changes in the environment such as external humidity.

The insulating substrate is provided with a terminal section at one end thereof, the outer terminal is provided with a connecting section at one end thereof, and the terminal section and the connecting section are projected from the opening of the casing and connected to each other only by being resiliently clamped by a clip terminal.

Furthermore, the cover is provided with slits, and the terminal section of the insulating substrate and the connecting section of the external terminal are protruded outward through the slits and connected to each other. Since only the terminal section and the connecting section protrude from the cover, the clamping thereof by means of the clip terminal is easy to perform.

Still furthermore, a protective cover is provided on the cover to cover the terminal section of the insulating substrate and the connecting section of the external terminal. Accordingly, the ingress of dirt and dust is prevented, and reliability of the contact between the clip terminal 44, and the terminal section 36 of the insulating substrate 24 and the connecting section 43 of the external terminal 28 is enhanced.

What is claimed is:

1. A variable resistor comprising:

a casing having an opening and defining an internal cavity;

a cover having a shaft hole, a through hole, and a terminal hole, said cover attachable to said casing so as to cover said opening;

an insulating substrate held by said casing and extending outward from said internal cavity through said cover via said through hole, said insulating substrate having an end portion adjacent to said cover and an end portion disposed opposing said end portion adjacent to said cover, said insulating substrate having a terminal pattern formed on said end portion adjacent to said cover and a resistor connected with said terminal pattern and extending from the adjacent end portion;

a slider in sliding contract with said resistor;

a slider receiver adapted to receive said slider, said slider receiver disposed in said internal cavity and movable in an axial direction parallel with said insulating substrate;

a shaft movably disposed in said shaft hole, said shaft operative to move said slider receiver in said axial direction and having a projection in contact with an inner surface of said cover around said shaft hole, said projection operative to prevent said shaft from being extracted from said shaft hole;

a return spring disposed in said internal cavity operative to restore said slider receiver in the axial direction in opposition to said shaft; and an external terminal held by said casing, said external terminal having a first end portion protruding outward from said cover through said terminal hole and a second end portion protruding from an outer surface of said casing, said first end portion of said external terminal electrically connected with said terminal pattern by a clip terminal;

wherein said clip terminal has a first arm extending along said insulating substrate in resilient contact with said terminal pattern, a second arm extending along said external terminal in resilient contact with said external terminal, and a base portion for connecting end portions of said first arm and said second arm, said first arm and said second arm both adjacent to said cover.

2. A variable resistor according to claim 1, wherein said cover is adapted to provide a protective shield, said protective shield being attached to said cover and operative to protect said first end portion of said external terminal protruding from said cover, said terminal pattern protruding from said cover, said through hole, said terminal hole, and said clip terminal.

3. A variable resistor comprising:

a casing having an opening and defining an internal cavity;

a control valve container attached to said casing;

a cover having a shaft hole, said cover attachable to said casing so as to cover said opening and disposed such that said cover is exposed in an interior of the control valve container;

an insulating substrate held by said casing, said insulating substrate having an end portion adjacent to said cover and an end portion disposed opposing said end portion adjacent to said cover, said insulating substrate having a terminal pattern formed on said end portion adjacent to said cover and a resistor connected with said terminal pattern and extending from the adjacent end portion;

a slider in sliding contract with said resistor;

a slider receiver adapted to receive said slider, said slider receiver disposed in said internal cavity and movable in an axial direction parallel with said insulating substrate;

a shaft movably disposed in said shaft hole, said shaft operative to move said slider receiver in said axial direction and having a projection in contact with an inner surface of said cover around said shaft hole, said projection operative to prevent said shaft from being extracted from said shaft hole;

a return spring disposed in said internal cavity operative to restore said slider receiver in the axial direction in opposition to said shaft; and an external terminal held by said casing, said external terminal having a first end portion extending from an inner surface of said casing toward said cover and a second end portion protruding from an outer surface of said casing, said first end portion of said external terminal electrically connected with said terminal pattern by a clip terminal;

wherein said clip terminal has a first arm extending along said insulating substrate in resilient contact with said terminal pattern, a second arm extending along said external terminal in resilient contact with said external terminal, and a base portion for connecting end portions of said first arm and said second arm, said first arm and said second arm both adjacent to said cover, and said cover is provided with a through hole, said end portion of said insulating substrate having said terminal pattern formed thereon and said first end portion of said external terminal protruding outside said cover through said through hole.

4. A variable resistor according to claim 3, wherein said cover is adapted to provide a protective shield, said protective shield being attached to said cover and operative to protect said first end portion of said external terminal protruding from said cover, said terminal pattern protruding from said cover, said through hole, and said clip terminal.

5. A variable resistor comprising:

a casing having an opening and defining an internal cavity;

a cover having a shaft hole, a through hole, and a terminal hole, said cover attachable to said casing so as to cover said opening;

an insulating substrate held by said casing and extending outward from said internal cavity through said cover via said through hole, said insulating substrate having an end portion adjacent to said cover and an end portion disposed opposing said end portion adjacent to said cover, said insulating substrate having a terminal pattern formed on said end portion adjacent to said cover and a resistor connected with said terminal pattern and extending from the adjacent end portion;

a slider in sliding contract with said resistor;

a slider receiver adapted to receive said slider, said slider receiver disposed in said internal cavity and movable in an axial direction parallel with said insulating substrate;

a shaft movably disposed in said shaft hole, said shaft operative to move said slider receiver in said axial direction and having a projection in contact with an inner surface of said cover around said shaft hole, said projection operative to prevent said shaft from being extracted from said shaft hole;

a return spring disposed in said internal cavity operative to restore said slider receiver in the axial direction in opposition to said shaft; and an external terminal held by said casing, said external terminal having a first end portion protruding outward from said cover through said terminal hole and a second end portion protruding from an outer surface of said casing, said first end portion of said external terminal electrically connected with said terminal pattern by a clip terminal.

6. A variable resistor according to claim 5, wherein said cover is adapted to provide a protective shield, said protective shield being attached to said cover and operative to protect said first end portion of said external terminal protruding from said cover, said terminal pattern protruding from said cover, said through hole, said terminal hole, and said clip terminal.

* * * * *